US011313254B2

(12) United States Patent
Fessler

(10) Patent No.: US 11,313,254 B2
(45) Date of Patent: Apr. 26, 2022

(54) VARIABLE VALVE ACTUATION

(71) Applicant: FPT MOTORENFORSCHUNG AG, Arbon (CH)

(72) Inventor: Harald Fessler, Arbon (CH)

(73) Assignee: FPT MOTORENFORSCHUNG AG, Arbon (CH)

( * ) Notice: Subject to any disclaimer, the term of this patent is extended or adjusted under 35 U.S.C. 154(b) by 0 days.

(21) Appl. No.: 16/979,591

(22) PCT Filed: Mar. 19, 2019

(86) PCT No.: PCT/IB2019/052219
§ 371 (c)(1),
(2) Date: Sep. 10, 2020

(87) PCT Pub. No.: WO2019/180611
PCT Pub. Date: Sep. 26, 2019

(65) Prior Publication Data

US 2021/0003042 A1 Jan. 7, 2021

(30) Foreign Application Priority Data

Mar. 19, 2018 (IT) ..... 102018000003742

(51) Int. Cl.
*F01L 1/18* (2006.01)
*F01L 1/26* (2006.01)
(Continued)

(52) U.S. Cl.
CPC ..... *F01L 1/185* (2013.01); *F01L 1/267* (2013.01); *F01L 1/2405* (2013.01);
(Continued)

(58) Field of Classification Search
CPC ..... F01L 1/185; F01L 1/267; F01L 1/2405; F01L 1/08; F01L 1/053; F01L 2305/02; F01L 2305/00; F01L 2001/34446; F01L 2013/0068; F01L 13/065; F01L 2800/10; F01L 9/14; F01L 2820/031
See application file for complete search history.

(56) References Cited

U.S. PATENT DOCUMENTS 4,258,671 A 3/1981 Takizawa et al.
5,002,022 A 3/1991 Perr
(Continued)

FOREIGN PATENT DOCUMENTS

JP S58148210 9/1983
JP 2008 223517 9/2008
(Continued)

*Primary Examiner* — Zelalem Eshete
(74) *Attorney, Agent, or Firm* — Leason Ellis LLP

(57) ABSTRACT

The present invention provides for Variable Valve Actuation comprising a cam, a valve suitable to displace between a closed position and an open condition caused by said cam, and further comprising a main rocker arm suitable to swing over a fulcrum, mechanically interacting with said valve, by means of a guide profile, and wherein said cam interacts with said main rocker arm causing said valve displacement as a consequence of said main rocker arm swinging. The target is to prevent a valve brake due to the guide profile and enable higher system stiffness. Accumulator less designs are feasible with this system.

15 Claims, 4 Drawing Sheets

(51) Int. Cl.
*F01L 1/24* (2006.01)
*F01L 1/344* (2006.01)
*F01L 13/00* (2006.01)

(52) U.S. Cl.
CPC ..... *F01L 2001/34446* (2013.01); *F01L 2013/0068* (2013.01); *F01L 2305/02* (2020.05)

(56) References Cited

U.S. PATENT DOCUMENTS

| | | | | |
|---|---|---|---|---|
| 6,886,512 | B2 * | 5/2005 | Naumann | F01L 13/0063 123/90.39 |
| 2014/0096729 | A1 | 4/2014 | Yapici | |
| 2015/0068475 | A1 | 3/2015 | Park | |

FOREIGN PATENT DOCUMENTS

| | | |
|---|---|---|
| WO | WO 98/07965 | 2/1998 |
| WO | WO 03/008772 | 1/2003 |

* cited by examiner

VARIABLE VALVE ACTUATION

CROSS-REFERENCE TO RELATED APPLICATIONS

This application is a U.S. National Phase Application under 35 U.S.C. § 371 of International Patent Application No. PCT/IB2019/052219, filed on Mar. 19, 2019, which claims priority from Italian Patent Application No. 102018000003742 filed on 19 Mar. 2018 Mar. 19, 2018, all of which are incorporated by reference, as if expressly set forth in their respective entireties herein.

FIELD OF THE INVENTION

The present invention relates to a variable valve actuation device, in particular in the field of heavy industrial vehicles.

DESCRIPTION OF THE PRIOR ART

Lost motion VVA systems are well known to the skilled person in the art.

They are usually controlled by modification of the hydraulic link in between a master piston, mechanically (in physical contact) driven for example by a cam, and the slave piston, (hydraulically) driven by the master piston via a hydraulic link. The hydraulic link can be modified by venting fluid, usually engine oil, in between the pistons to change the valve lift profile, but this leads to an uncontrolled closing of the engine valve, since it does not follow anymore the complete cam profile with the ramps.

A valve brake system (valve catch) is required for all these hydraulic options to realize acceptable seating velocities.

However, this solution is not optimal because the braking effect is always present leading the components defining the VVA to be subjected to relevant forces and increased engine noise. A further disadvantage is the reduced valve train stiffness due to the hydraulic link which bears the forces developed on the valves.

SUMMARY OF THE INVENTION

Therefore, it is the main object of the present invention to provide a Variable Valve Actuation (VVA) capable to solve, at least in an alternative way, the above problems/drawbacks, in particular, capable to guide a valve seating also during variation of the valve actuation, without any implementation of valve brake systems.

The main principle of the invention is to introduce a main rocker arm, oscillating over a fulcrum, slidinghly interacting with a valve stem, directly or indirectly through a secondary roller rocker arm, by means of a slidinghly guide profile and wherein a cam, suitable to rotate over its own axis, interacts with said main rocker arm mechanically or hydraulically, namely directly or indirectly. The introduction of the main rocker arm leads in addition to improved valve train stiffness.

The main rocker arm is charged by a main spring, which pushes the main rocker arm towards a "home" position.

The hydraulic interaction can be realized by means of a hydraulic circuit comprising a main and a slave piston.

An oil accumulator can be connected to the hydraulic circuit.

According to the present description, with "mechanical interaction" is intended the physical contact between rigid components to define a direct interaction between them to transmit the valve actuation from the cam shaft to the valve stem, while with "hydraulic interaction" is meant an indirect interaction between two rigid components, such as a master and slave piston working on a liquid, usually, engine oil.

According to a first preferred embodiment of the invention, said fulcrum is fixed and said interaction between the camshaft and the main rocker arm is hydraulic, by means of hydraulic actuation.

According to a second preferred embodiment of the invention, said fulcrum is movable due to a hydraulic arrangement, and said interaction between the camshaft and the main rocker arm is mechanical.

For each of said first and second embodiments two sub-embodiments are disclosed in the following detailed description with and without an oil accumulator.

Anyway, according to the present invention, the main rocker arm profile converts the cam profile into a valve lift and when the kinematic interconnection with the camshaft is lost, due to a temporary oil vent from the hydraulic link or hydraulic assembly the main spring operates the main rocker arm in order to impose to the valve a guided motion controlled by the profile of the main rocker arm.

Thanks to said profile a valve brake is avoided, because even when the fulcrum of the main rocker arm is displaced or the hydraulic actuator is vented, the valve have to follow the main rocker arm profile.

The forces from the engine valve is supported mainly by the fulcrum of the main rocker arm, thus the system discloses an increased stiffness and durability even in prolonged heavy duty operation.

Increased system stiffness is especially important for engine braking since the valve force during decompression is very high.

Advantageously, the final rocker ratio can be adjusted by the profile on the main rocker arm and by varying the ratio between the arms First distance between the fulcrum and the average guide profile and Second distance between the fulcrum and the point of direct or indirect interaction with the camshaft.

The valve lash can be adjusted especially when a secondary roller rocker arm is implemented. Indeed, in this case, the action of the main rocker arm is transmitted to a roller of the secondary rocker arm having a first end in contact with the valve stem and an opposite end guided by a lash adjuster that can be either a mechanical adjusted or an automatic lash hydraulic adjuster (HLA).

In other words the main rocker arm works as a secondary cam suitable to oscillate instead of rotate as the usual cams.

These and further objects are achieved by means of the attached claims, which describe preferred embodiments of the invention, forming an integral part of the present description.

BRIEF DESCRIPTION OF THE DRAWINGS

The invention will become fully clear from the following detailed description, given by way of a mere exemplifying and non limiting example, to be read with reference to the attached drawing figures, wherein.

The same reference numerals and letters in the figures designate the same or functionally equivalent parts.

According to the present invention, the term "second element" does not imply the presence of a "first element", first, second, etc. are used only for improving the clarity of the description and they should not be interpreted in a limiting way.

DETAILED DESCRIPTION OF THE PREFERRED EMBODIMENTS

The system comprises a cam CS having two or more humps 1, 2, 3 commanding the motion of at least a valve V.

According to all the figures, the camshaft CS, due to its profile, determines the motion of a main rocker arm MA.

Figure 1:
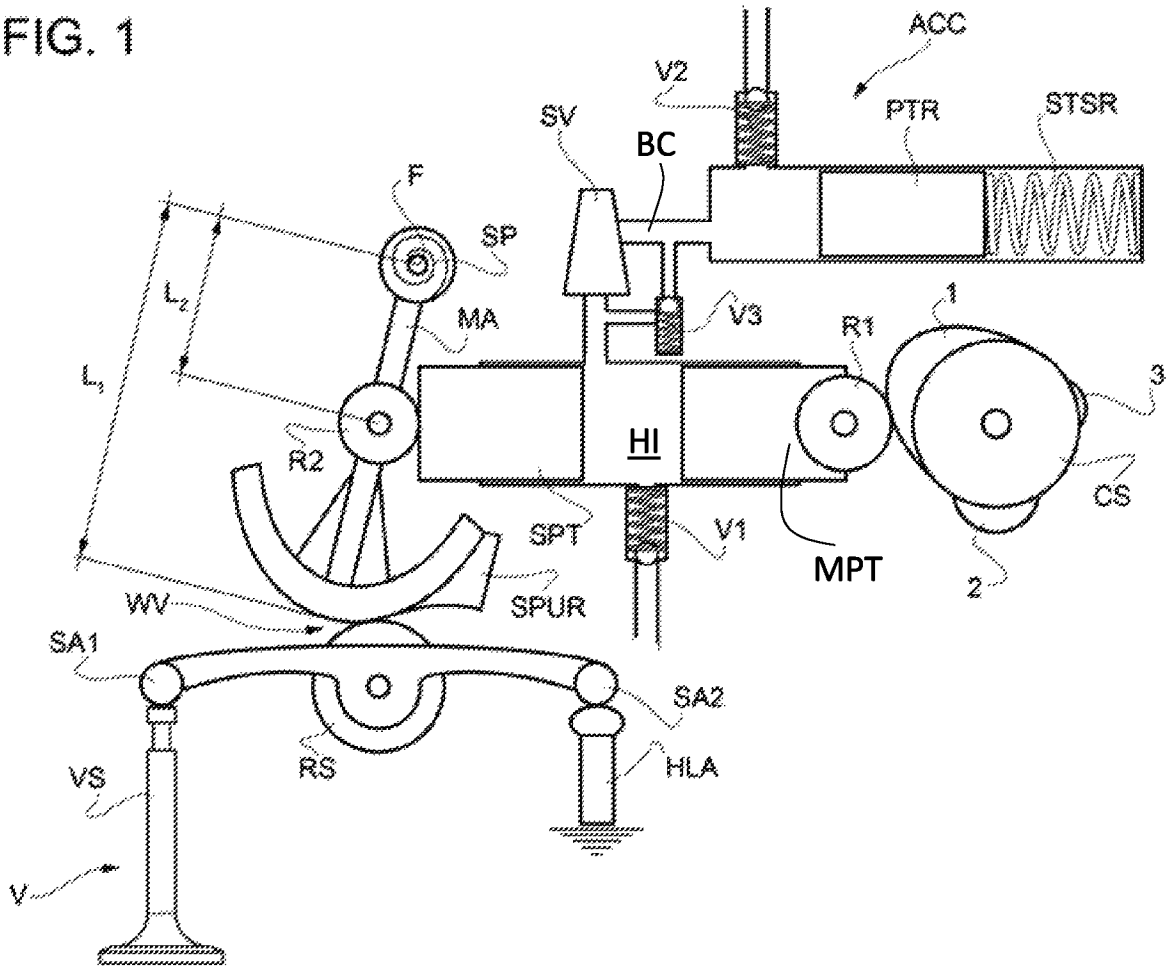
FIGS. 1 and 2 show schematically a first and a second example implementation of the present invention with a main rocker arm having fixed fulcrum.

The main rocker arm MA, according to FIG. 1 has the shape of an anchor: an elongated arm having a first end fixedly associated with a fulcrum F and a second end, opposite to the first one, associated with a circumference arc defining a guide profile WV.

The camshaft interacts with the elongated arm of the main rocker arm in an intermediate point R2 between the fulcrum and the guide profile WV.

The guide profile WV interacts directly with a valve steam, for example by providing the valve stem VS with a secondary roller RS or can interact with the valve stem VS indirectly, by means of an auxiliary rocker arm SA, known as finger-follower.

The finger follower has two opposite ends SA1 and SA2. The first is in contact with the free end of the valve stem, while the second end SA2 is supported by an HLA, namely a lash adjuster, supported, in turn, by a fixed portion of the head of the engine cylinder. In an intermediate position, a roller RS is associated to the auxiliary rocker arm to mechanically (physically) interact with the guide of the main rocker arm.

According to all the embodiments herewith described, the rotation axis of the cam CS, the fulcrum F, the rotation axis of the roller RS are parallel between each another and perpendicular to the sheets.

The secondary rocker arm can be per se known. It is an elongated element having two opposite ends SA1 and SA2.

The first end SA1 is in mechanical contact with a valve steam VS, while the second end SA2 is in operating contact with a lash adjuster. The lash adjuster can be mechanical or hydraulic HLA. This last type is, preferably, filled with engine oil and automatically adjusts the valve lash.

In an intermediate position of the secondary arm a secondary roller RS is arranged.

The secondary roller RS is in direct contact with the guide profile WV, thus when the main rocker arm oscillates under the command of the camshaft, the secondary roller follows the guide profile WV of the main rocker arm.

It should be understood that the secondary roller RS is not essential, therefore, the interaction between the guide profile WV and the valve V or the finger follower SA can be slidingly or rollingly in case the roller RS is present.

According to the invention, the guide profile is shaped so as the swinging of the main rocker arm defines a ramp in terms of opening profile.

The profile of the cam CS defines the rotational angle and velocity of the main rocker arm. The angular position of the main rocker arm is transferred via the ramp profile into a motion of the roller RS at the finger follower SA. Finally, the secondary rocker arm ratio defines the valve lift.

The valve lift depends on: Cam profile, Anchor ratio in terms of arms L1/L2, Anchor guide profile WV, finger follower geometry.

The Anchor ratio is the ratio between the distances

L1: entire length of the first elongated element from the fulcrum F to the guide profile, L2: fulcrum F to intermediate point R2, where hydraulic link acts.

Figure 3:
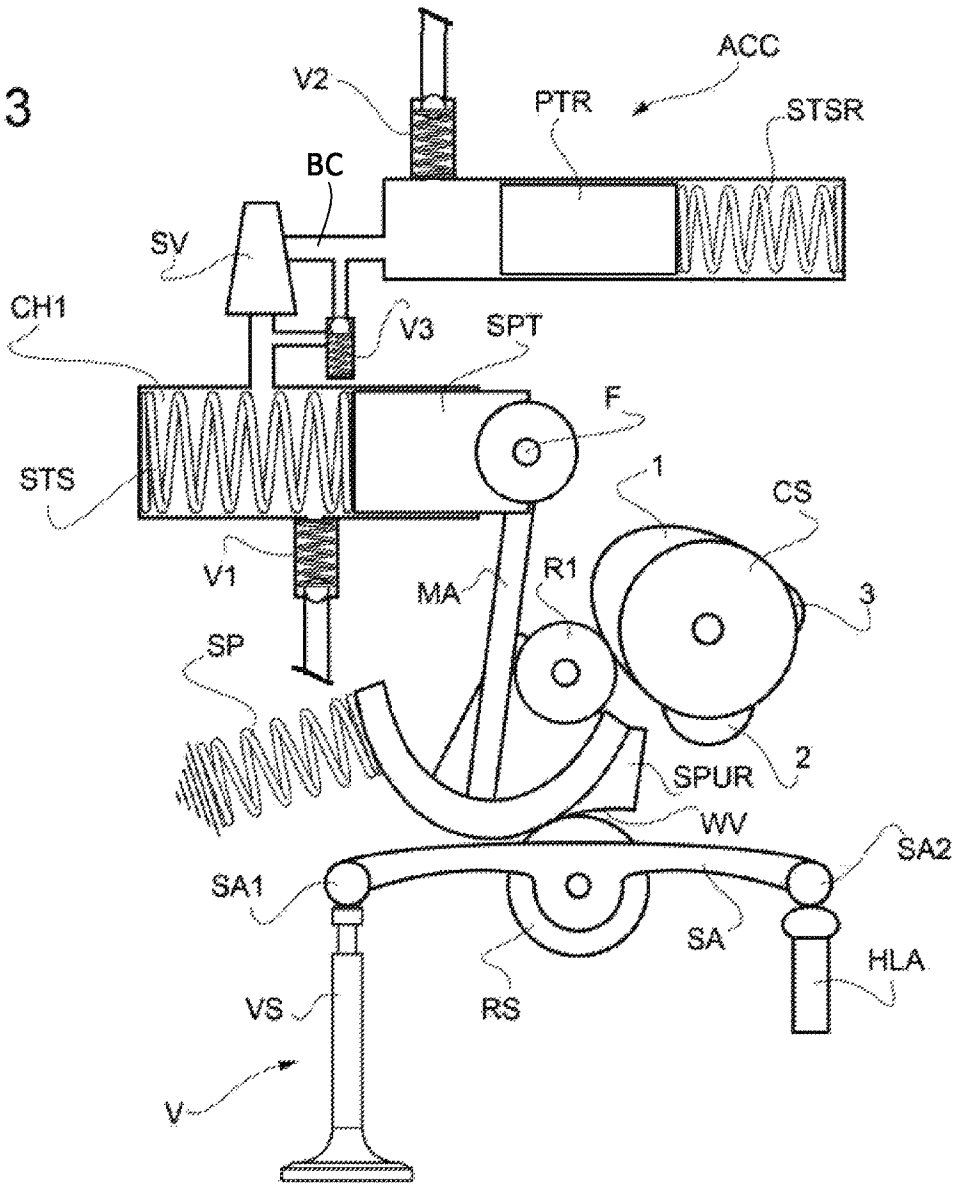
FIGS. 3 and 4 show schematically a third and a fourth example implementation of the present invention with a main rocker arm having a movable fulcrum.
Figure 4:
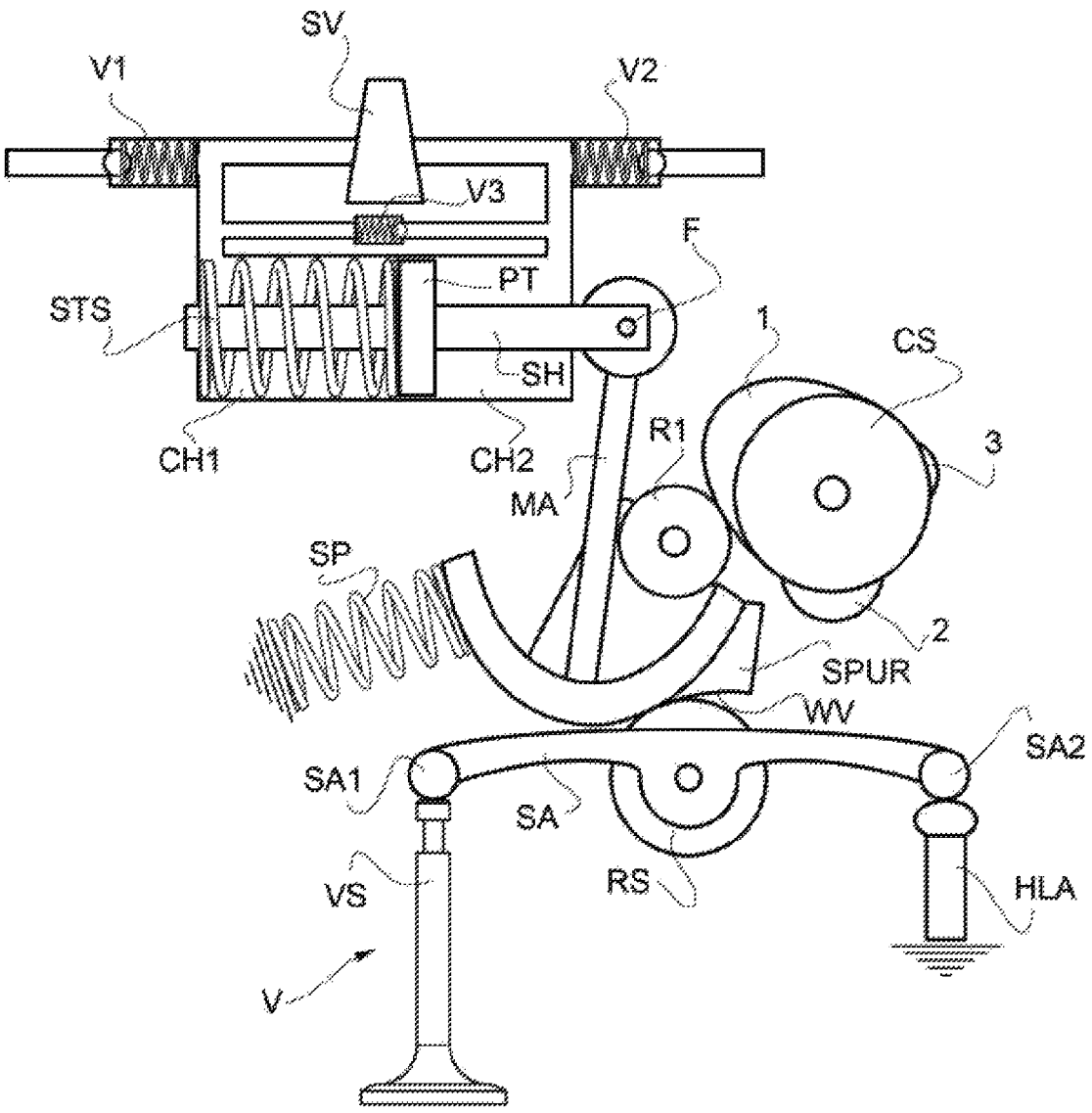

According to the examples of FIGS. 1, 3 and 4, where the main rocker arm has an anchor shape, such guide profile is obtained by means of a sort of spur SPUR protruding from one side of the circumferential arc defining the anchor shape.

Figure 2:
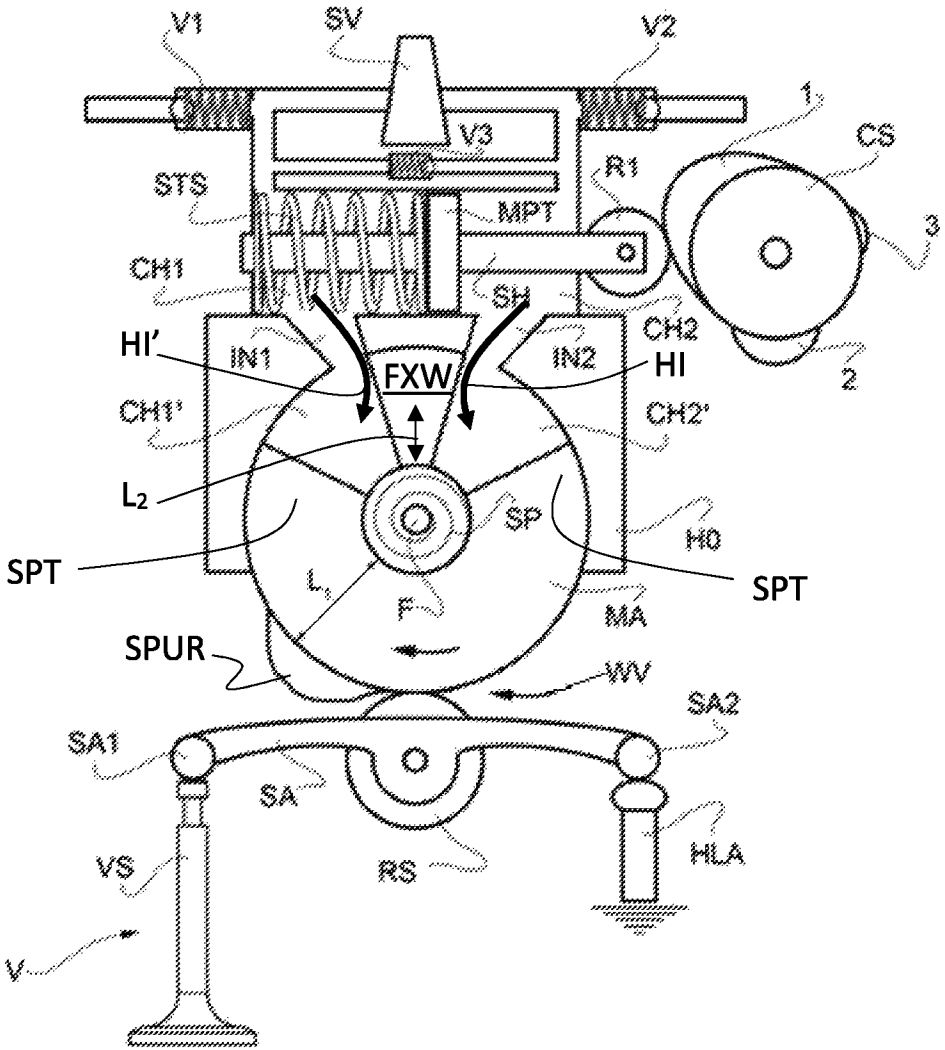

According to the example of FIG. 2 the guide profile is obtained by means of a sort of hump protruding from a circumference. However, the concept is unchanged. More details will be given in the following.

Coming back on the example of FIG. 1, the motion is transmitted from the camshaft CS to the intermediate point R2 of the main rocker arm by means of a hydraulic interconnection comprising a master piston MPT and a slave piston SPT. The hydraulic interconnection HI can have the shape of a cylinder with two pistons: master MPT and slave SPT slidingly associated with opposite ends of the cylinder.

The master piston is in operative contact with the camshaft CS by means a roller R1. The slave piston is hydraulically associated with master piston and is in physical contact with the intermediate point R2 of the main rocker arm.

Therefore, the profile of the camshaft is transmitted indirectly to the main rocker arm MA through the hydraulic link HI.

The distension of the hydraulic interconnection HI varies the angular position of the main rocker arm, by varying the response of the assembly to the cam command.

Therefore, a larger distension of the hydraulic interconnection HI causes a larger valve lift. Vice versa smaller distension causes a smaller valve lift.

The main rocker arm MA is charged by means of a spring SP which can be operatively enslaved on the fulcrum of the main rocker arm, see FIG. 1 or 2, or can be interposed between a fixed point of the head of the corresponding internal combustion engine and a portion of the main rocker arm in order to push the main rocker arm towards the slave piston SPT, see FIG. 3 or 4.

An oil accumulator ACC is hydraulically connected with the hydraulic interconnection/link HI between the master piston MPT and the slave piston SPT, by means of a branch pipe BC. A fast solenoid valve SV is arranged on the branch pipe, interposed between the accumulator and the above hydraulic interconnection/link.

Such fast solenoid valve SV is arranged to control the venting of the high pressure oil trapped in between the master and the slave piston and hence enable the variable valve motion. It is vented into the accumulator, which permits a fast refill of the hydraulic interconnection/link HI.

Since the hydraulic interconnection between the master piston MPT and the slave piston SPT always leaks oil, the check valves V1 and V2 connect respectively the hydraulic interconnection HI and the accumulator with the main gallery of the oil circuit of the corresponding internal combustion engine, to refill said hydraulic portions of the circuit during an unloaded time window.

Preferably, another check valve V3 is arranged in parallel with the valve SV to bypass thereof permitting refilling of the hydraulic interconnection HI from the accumulator even when solenoid valve SV is closed. The implementation of a check valve in parallel with the solenoid valve is common practice, well known by the skilled person in art.

Advantageously, the valve, through the guide profile defined by the main rocker arm, is imposed to follow a predetermined trajectory, independently by the conditions of the hydraulic connection HI. Therefore, the valve is always driven by the ramp profile.

The solution disclosed in FIG. 2 is similar to the solution of FIG. 1.

The main rocker arm and the slave piston are integrated in one single component.

The main rocker arm defines a circular rotatable actuator inserted in a complimentary housing HO.

This rotatable actuator is provided with a movable septum SPT dividing two opposite chambers CH1' and CH2' supplied with oil through as much inlets IN1 and IN2 realized in the complimentary housing HO. A fixed wall FXW defines a double action piston capable to rotate over the fulcrum F, inducing a rotation of the main rocker arm MA, where septum and main rocker arm are in one piece. Such inlets are, in turn, supplied with oil by two opposite chambers CH1 and CH2 of a double action piston MPT, displaceable in a relative cylinder such that each face of the piston project in one of such opposite chambers CH1 and CH2.

Therefore, the chamber CH1 and CH1', on one side, with CH2 and CH2', on the opposite side, define the hydraulic interconnection HI described above in respect of the embodiment of FIG. 1.

Here two opposite hydraulic interconnections can be identified HI and HI'.

When oil is pumped through the IN1 in the chamber CH1' the sole way to permit the chamber CH1' to expand is rotating the Spur in an anti-clockwise direction. While, when the oil is pumped in the opposite chamber CH2, the sole way to permit the chamber CH2' to expand is to rotate the Spur in the clockwise direction, according to the view of FIG. 2. It should be understood that the septum is disclosed as a solid and thick wall covering 270° C. circa. However, it could be a slim wall, thus the chambers CH1' and CH2' would be larger, being complementary to the septum within the rotatable main rocker arm MA.

Even in the embodiment of FIG. 2, it is possible to identify the arms L1 and L2. L1 can be identified as for the embodiment of FIG. 1, while L2 corresponds to the medial point of the fixed wall FXW.

The (master) piston MPT is commanded through a relative shaft, by the camshaft CS operatively associated with said shaft SH by means of a roller R1.

A displacement of the double action (master) piston MPT determines the flowing of oil from the chamber CH1 (or CH2) to the chamber CH1' (or CH2') by forcing, correspondently a rotation of the main rocker arm MA which, thus defines a double action slave piston with its opposite chambers CH1' and CH2'.

A first spring SP enslaved on the fulcrum F of the main rocker arm pre-charges the latter to force the cam into the home position. In particular the spring rotate the MA in an anti-clockwise direction, such that the chamber CH1' is compressed and the corresponding CH1 chamber in the master piston PT is expanded. This condition leads the roller R1 to contact the cam CS.

A second spring STS pre-charges the double action (master) piston PT to maintain its shaft SH in constant contact with the camshaft.

It should be noted that, while in FIG. 1 the spur combined with the semi-circumference of the anchor shape defines the above guide, here according to this second example, the guide profile is defined by a hump SPUR projecting from the general circumference of the main rocker arm shaped as a cam.

This guide profile WV is similar to FIG. 1 leading to the same valve displacement.

In any case, for the first and second embodiments, the spring SP enslaved over the fulcrum or interposed between a fixed point of the head of the corresponding internal combustion engine and a portion of the main rocker arm, is arranged so as to achieve a "home position", namely to correctly position the guide profile with respect to the roller RS.

This second embodiment, disclosed on FIG. 2, beyond the specific implementation of the main rocker arm implementing also a double action slave piston, is accumulator-less, in contrast with the first embodiment according to FIG. 1.

Here, the solenoid valve SV is implemented to short circuit the above opposite chamber CH1 and CH2 of the double action piston MPT. The action of the fast solenoid valve SV permits to quickly move oil from one chamber to the other one and vice versa.

As for the previous embodiment, check valves V1 and V2 are implemented to selectively refill the chambers CH1 and CH2 from the main gallery of the oil circuit of the corresponding internal combustion engine.

FIGS. 3 and 4 represent an arrangement where the "flexibility" conferred by the hydraulic link, is implemented to the pivot point instead of the drive as disclosed in FIGS. 1 and 2. Thus, the first end of the main rocker arm, opposite to the end defining the guide profile WV is rotatably connected to a slave piston SPT associated to a first chamber CH1, wherein a spring STS is arranged to push the piston SPS towards its maximal elongation.

Here, the distension/retraction of the hydraulic support SPT varies the reciprocal position between the main rocker arm and the cam SC. This causes a variation of the angular position of the main rocker arm, by varying the response of the assembly to the cam command.

These embodiments are more efficient since the interaction between the cam and the main rocker arm is direct, without an intermediate hydraulic link, thus oil flows only at trigger event leading to the fulcrum translation in order to achieve cutting of the lift profile.

In contrast with the previous embodiments, the camshaft directly, namely physically, interacts with the intermediate point R1 of the main rocker arm MA, preferably, shaped as an anchor as disclosed in accordance with FIG. 1.

FIG. 3 discloses a solution including an oil accumulator ACC, where a piston PTR is charged by a spring STSR to compress oil towards the hydraulic support of the fulcrum F of the main rocker arm. The hydraulic support includes a cylinder defining a chamber CH1 and piston SPT emerging from the cylinder. On the emerging portion of the piston is hinged the main rocker arm MA.

A spring STS is housed in the chamber CH1 to pre-charge piston. The fast solenoid valve SV is arranged, as in FIG. 1, on the branch pipe BC, connecting the accumulator and the chamber CH1 of the hydraulic link, even if, here, the hydraulic link supports the fulcrum of the main rocker arm MA. Thus, the opening of the solenoid valve permits increasing of the force acting on the piston SPT, pushing it outside the cylinder.

The hydraulic support CH1, SPT is arranged on one first side of the main rocker arm, while the cam CS is arranged on the secondo side of the main rocker arm, opposite to said first one. Therefore, a larger distension of the hydraulic support causes a larger valve lift. Vice versa smaller distension causes a smaller valve lift.

In case hydraulic support CH1, SPT and cam CS were arranged on the same side, then a smaller distension of the hydraulic support causes a larger valve lift and vice versa.

Again, check valves V1 and V2 are arranged as refill valves, to refill respectively the accumulator and the chamber CH1 of the hydraulic support of the fulcrum, and, again, V3 is a bypass valve arranged in parallel with the solenoid valve SV to enable refill from the accumulator even when the solenoid valve SV is closed. In addition, the bypass valve V3 permits overpressure discharge of the chamber CH1 into the accumulator.

FIG. 4 discloses a fourth embodiment of the invention, mixing the features of the embodiment of FIG. 3, where the fulcrum F is movable and the features of the hydraulic actuator of FIG. 2, here implemented to cause the motion of the fulcrum of the main rocker arm without implementing an accumulator.

In particular, the main rocker arm MA is hinged on a shaft SH in one piece of a double action piston PT facing two opposite chambers CH1 and CH2. As already disclosed, a fast solenoid valve is arranged to short circuit said chambers CH1 and CH2 and a valve V3 is arranged in parallel to the fast solenoid valve to permit oil flowing among the chambers when a predetermined oil pressure threshold is exceeded, independently of the state of the fast solenoid valve.

Valves V1 and V2 are arranged to refill the chambers CH1 and CH2 from the engine main gallery.

Hydraulic support of the fulcrum and cam CS are arranged on opposite sides of the main rocker arm.

A spring SP is arranged between the main rocker arm and a fixed point of the engine head to push the main rocker arm in a predetermined "home position".

From the description of the above embodiments 1-4, it is clear that an hydraulic actuator is implemented to vary the swinging operation of the main rocker arm or as intermediate element between the main rocker arm and the cam CS or to shift the fulcrum of the main rocker arm.

From the comparison of the first and second embodiments with the third and fourth embodiments it is clear that according to the first two embodiments the roller RS is forced to follow the trajectory defined by the guide profile WV, with a sort of amplification of the camshaft command. Instead, according to the second two embodiments the ramp defined by the guide profile has a variable inclination according to the fulcrum motion.

The hydraulic connection or hydraulic support induces a relative movement of the main rocker arm with the cam CS, this enables the activation/deactivation of additional humps 2, 3. For example, if the present invention is implemented on the exhaust valves, such hump can permit internal EGR and/or recharging hump (2) as well as an engine braking profile (3).

When the present invention is applied to the intake valves, the additional hump enables internal EGR.

In general, the presence of the accumulator is useful for a fast refill of the system (FIGS. 1 and 3). V1 and V2 are compensating the leakages. V3 is a bypass valve to the trigger valve enabling only oil flow into the direction of the base system position.

Thus, Comparing FIG. 4 with FIG. 3, FIG. 3 shows a good example of accumulator-less system. If the oil is moved from one to the other side of the piston PT, there is no need of an accumulator to store the oil. Storage is required to get short distances for fast refill and reduced losses. The accumulator is at the low pressure side hence there is no direct impact on performance, beside refill.

According to the present description the variable valve actuation is described in connection with the interaction between the cam CS and main rocker arm MA or in connection with the position of the main rocker arm fulcrum. Nevertheless, both the solution can be implemented at the same time to improve the system responsiveness.

Many changes, modifications, variations and other uses and applications of the subject invention will become apparent to those skilled in the art after considering the specification and the accompanying drawings which disclose preferred embodiments thereof as described in the appended claims.

The features disclosed in the prior art background are introduced only in order to better understand the invention and not as a declaration about the existence of known prior art. In addition, said features define the context of the present invention, thus such features shall be considered in common with the detailed description.

Further implementation details will not be described, as the man skilled in the art is able to carry out the invention starting from the teaching of the above description.

The invention claimed is:

1. A Variable Valve Actuation comprising a cam, a valve suitable to displace between a closed position and an open condition caused by a rotation of said cam, and further comprising a main rocker arm suitable to swing over a fulcrum, mechanically interacting with said valve, by means of a guide profile, and wherein said cam interacts slidingly or rollingly with said main rocker arm causing said valve displacement as a consequence of said main rocker arm swinging, wherein said variable valve actuation is obtained by a hydraulic interconnection that is arranged to move said fulcrum relative to said cam to modify said mechanical interaction;

wherein said cam interacts directly with said main rocker arm and said fulcrum is movable; wherein said fulcrum is supported by a support piston of a hydraulic circuit that forms part of the hydraulic interconnection.

2. The variable valve actuation according to claim 1, wherein said guide is shaped as a circumference arc provided of a spur, in such a way to define a ramp valve displacement as a consequence of said swinging.

3. The variable valve actuation according to claim 2, wherein said main rocker arm is pre-charged by a home spring in order to press the main rocker arm towards or against the cam.

4. The variable valve actuation according to claim 3, wherein said home spring is a spiral enslaved on said fulcrum or is a spring interposed between said main rocker arm and a fixed point of a head of an engine including said variable valve actuation.

5. The variable valve actuation according to claim 1, wherein said main rocker arm interacts with said valve, directly or indirectly by means of an auxiliary rocker arm defining a so called finger follower configuration.

6. The variable valve actuation according to claim 1, wherein said support piston is pre-charged toward a complete distension by means of a spring arranged in a chamber identified by said support piston and wherein the hydraulic circuit further comprises an oil accumulator connected with said chamber by means of a branch pipe, wherein a solenoid valve is arranged thereon in order to control oil flowing from/to said chamber to/from said oil accumulator.

7. The variable valve actuation according to claim 1, wherein said support piston is a double action piston defining two opposite chambers, pre-charged toward a complete distension by means of a spring arranged in one of said opposite chambers, wherein a solenoid valve is arranged to short-circuit said opposite chambers.

8. The variable valve actuation according to claim 1, wherein said support piston is arranged in an opposite position with said cam with respect to said main rocker arm.

9. The variable valve actuation according to claim 8, wherein said home spring, when interposed between said main rocker arm and said fixed point, is arranged on a same side of said support piston with respect to said main rocker arm.

10. The variable valve actuation according claim 1, wherein said cam interact indirectly with said main rocker arm and said fulcrum is fixed.

11. The variable valve actuation according to claim 10, wherein said indirect interaction comprises hydraulic interconnection comprising a master piston having a protruding portion supporting a roller mechanically interacting with said cam, and the support piston that comprises a slave piston directly interacting with said main rocker arm, wherein said hydraulic circuit comprises a common hydraulic circuit shared by said master and slave pistons.

12. The variable valve actuation according to claim 11, wherein said indirect interaction further comprises an oil accumulator in hydraulic connection with said hydraulic circuit by means of a branch pipe and a solenoid valve arranged thereon in order to control oil flowing from/to said hydraulic connection to/from said oil accumulator.

13. A variable valve actuation comprising:

a cam, a valve suitable to displace between a closed position and an open condition caused by a rotation of said cam, and further comprising a main rocker arm suitable to swing over a fulcrum, mechanically interacting with said valve, by means of a guide profile, and wherein said cam interacts slidingly or rollingly with said main rocker arm causing said valve displacement as a consequence of said main rocker arm swinging, wherein said variable valve actuation is obtained by a hydraulic interconnection that is interposed between said cam and said main rocker arm and is arranged to modify said mechanical interaction;

wherein said cam interacts indirectly with said main rocker arm and said fulcrum is fixed, wherein said indirect interaction comprises the hydraulic interconnection that comprises a master piston and a slave piston;

wherein said main rocker is globally shaped as an anchor and wherein said slave piston interacts with an intermediate portion of a stem of the anchor.

14. A variable valve actuation comprising:

a cam, a valve suitable to displace between a closed position and an open condition caused by a rotation of said cam, and further comprising a main rocker arm suitable to swing over a fulcrum, mechanically interacting with said valve, by means of a guide profile, and wherein said cam interacts slidingly or rollingly with said main rocker arm causing said valve displacement as a consequence of said main rocker arm swinging, wherein said variable valve actuation is obtained by a hydraulic interconnection that is interposed between said cam and said main rocker arm and is arranged to modify said mechanical interaction;

wherein said cam interact indirectly with said main rocker arm and said fulcrum is fixed;

wherein said main rocker arm is arranged to define a slave double-action piston defining two opposite first chambers, each chamber being connected to an individual hydraulic circuit that forms part of the hydraulic interconnection, wherein each of said hydraulic circuits is connected with a chamber of a master double-action piston including opposite second chambers, wherein the master double-action piston is fixed with a shaft, bearing a roller in mechanical contact with said cam, so that an interaction of said roller with said cam causes said master double-action piston to slide, pumping oil in one of said hydraulic circuits at a time, causing said main rocker arm to swing.

15. The variable valve actuation according to claim 14, further comprising a solenoid valve arranged to short-circuit said opposite second chambers.

* * * * *